US009181013B2

(12) United States Patent
Aoki

(10) Patent No.: US 9,181,013 B2
(45) Date of Patent: Nov. 10, 2015

(54) LIQUEFIED GAS TANK

(75) Inventor: Eiji Aoki, Minato-ku (JP)

(73) Assignee: JAPAN MARINE UNITED CORPORATION (JP)

( * ) Notice: Subject to any disclaimer, the term of this patent is extended or adjusted under 35 U.S.C. 154(b) by 22 days.

(21) Appl. No.: 14/127,681

(22) PCT Filed: Jun. 19, 2012

(86) PCT No.: PCT/JP2012/065598

§ 371 (c)(1),
(2), (4) Date: Dec. 19, 2013

(87) PCT Pub. No.: WO2012/176757

PCT Pub. Date: Dec. 27, 2012

(65) Prior Publication Data

US 2014/0131360 A1 May 15, 2014

(30) Foreign Application Priority Data

Jun. 24, 2011 (JP) ..... 2011-140410

(51) Int. Cl.
*B65D 81/18* (2006.01)
*F17C 3/02* (2006.01)

(52) U.S. Cl.
CPC . *B65D 81/18* (2013.01); *F17C 3/02* (2013.01); *F17C 2201/0119* (2013.01);
(Continued)

(58) Field of Classification Search
CPC ..... F17C 1/04; F17C 3/00; F17C 5/02; F17C 13/08; F17C 13/126; F17C 2203/03; F17C 2203/0375; F17C 2203/0379; F17C 2203/0626; F17C 2203/0629; F17C 2203/0685; F17C 2205/01; F17C 2205/0103; F17C 2205/018; F17C 2205/03; F17C 2270/00; F17C 2270/01; F17C 2270/0134; F17C 2270/0105; B65D 81/18; B63B 25/08; B63B 25/16
USPC ..... 220/636, 560.04, 560.05, 560.06, 220/560.08, 560.1, 560.12, 560.14, 565, 220/567.2, 581, 585
See application file for complete search history.

(56) References Cited

U.S. PATENT DOCUMENTS 3,374,641 A * 3/1968 Corvino et al. ..... 62/45.1
3,793,976 A * 2/1974 Kleinmann ..... 114/74 A
(Continued)

FOREIGN PATENT DOCUMENTS

JP 5027108 A 3/1975
JP 59160692 A 9/1984
(Continued)

OTHER PUBLICATIONS

English translation for JP 5022289.*
(Continued)

*Primary Examiner* — Fenn Mathew
*Assistant Examiner* — Robert Stodola
(74) *Attorney, Agent, or Firm* — Volpe and Koenig, P.C.

(57) ABSTRACT

A liquefied gas tank includes an inner tank (2) that stores liquefied gas and is disposed so as to be capable of self-standing on a floor surface (F), and an outer tank (3) that is covered over the inner tank (2) and is supported by an upper face portion (2*a*) of the inner tank (2). The outer tank (3) is configured to be capable of sliding on the upper face portion (2*a*) of the inner tank (2) in response to expansion and contraction in the horizontal direction of the inner tank (2), and to be capable of moving in response to expansion and contraction in the vertical direction of the inner tank (2). A ceiling portion (3*a*) of the outer tank (3) that is placed on the upper face portion (2*a*) of the inner tank (2) is not fixed to the upper face portion (2*a*) of the inner tank (2), and the inner tank (2) and the outer tank (3) are configured to be capable of sliding in the horizontal direction relative to each other. The outer tank (3) includes an expansion and contraction mechanism portion (33) that is disposed along the lower outer circumference thereof.

9 Claims, 29 Drawing Sheets

(52) U.S. Cl.
CPC .... *F17C 2201/032* (2013.01); *F17C 2201/052* (2013.01); *F17C 2203/0304* (2013.01); *F17C 2203/0629* (2013.01); *F17C 2205/018* (2013.01); *F17C 2209/232* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2260/037* (2013.01); *F17C 2270/0134* (2013.01)

(56) References Cited

U.S. PATENT DOCUMENTS

| | | | | | |
|---|---|---|---|---|---|
| 3,839,981 | A | * | 10/1974 | Gilles | 114/74 A |
| 3,882,809 | A | | 5/1975 | Johnson et al. | |
| 3,968,764 | A | * | 7/1976 | Kvamsdal et al. | 114/74 A |
| 4,176,761 | A | * | 12/1979 | Gobl | 220/560.06 |
| 4,976,110 | A | * | 12/1990 | Reid | 62/45.1 |
| 5,464,116 | A | * | 11/1995 | Aoki et al. | 220/586 |
| 6,484,899 | B1 | * | 11/2002 | Garton | 220/630 |
| 7,174,841 | B2 | * | 2/2007 | Lindholm et al. | 114/74 A |
| 2007/0125789 | A1 | | 6/2007 | Abdo | |

FOREIGN PATENT DOCUMENTS

| | | | |
|---|---|---|---|
| JP | 522289 | U | 3/1993 |
| JP | 07248097 | A | 9/1995 |
| JP | 08295394 | A | 11/1996 |
| JP | 2007278400 | A | 10/2007 |
| JP | 2008534371 | A | 8/2008 |
| JP | 2011000901 | A | 1/2011 |
| WO | 2006104386 | A1 | 10/2006 |

OTHER PUBLICATIONS

English translation for JP 7248097.*
International Search Report, PCT/JP2012/065598, Aug. 9, 2012, 4 pp.

* cited by examiner

LIQUEFIED GAS TANK

FIELD OF INVENTION

The present invention relates to a liquefied gas tank for storing liquefied gas, and more particularly to a liquefied gas tank that is suitable for storing a cryogenic liquid such as LNG (liquefied natural gas).

BACKGROUND

Conventionally, a transport ship (tanker), a floating storage unit, an above-ground storage facility, an underground storage facility and the like are used for transportation or storage of cryogenic liquids such as LNG (liquefied natural gas) and LPG (liquefied petroleum gas) (for example, see Patent Literature 1 and Patent Literature 2).

In Patent Literature 1, a liquefied gas carrying vessel is disclosed that includes an outer tank that constitutes the hull of a ship, and a tank (inner tank) that is disposed in a self-standing state inside the outer tank. In Patent Literature 2, an above-ground LNG tank is disclosed that includes an outer tank that is disposed on the ground and an inner tank that is disposed in a self-standing state inside the outer tank. By adopting a configuration in which an inner tank that stores liquid cargo is independent from an outer tank in this manner, the inner tank can be protected from the external environment while allowing expansion and contraction (thermal expansion and thermal contraction) of the inner tank that accompanies changes in the temperature of the liquid cargo.

CITATION LIST

Patent Literature

Patent Literature 1: Japanese Patent Laid-Open No. 2011-901

Patent Literature 2: Japanese Patent Laid-Open No. 2007-278400

SUMMARY

Technical Problem

In recent years, natural gas has been attracting attention as an environmentally friendly energy because, in comparison to petroleum, emissions such as carbon dioxide and nitrogen oxides are small when natural gas is burnt, and natural gas does not generate sulfur oxides. Further, because natural gas is buried in the ground in abundance at various places around the world, there is a high level of stability with respect to the supply of natural gas, and the introduction of natural gas as an alternative energy to petroleum is being studied. When natural gas is used as an energy source in this manner, liquefying the natural gas makes it possible to reduce the volume thereof to 1/600 the volume of natural gas in the gaseous state, and thus the storage efficiency can be improved. Accordingly, adopting a structure in which an inner tank is caused to stand independently from an outer tank as an LNG storage facility (liquefied gas tank) as disclosed in Patent Literature 1 and Patent Literature 2 is easily conceivable.

However, when using natural gas as an energy source, in the case of adopting the above described liquefied gas tank that has a self-standing structure in which a storage amount is a comparatively small amount of approximately 1/10 to 1/100 the storage amount of a conventional transport ship or storage facility, a massive facility is required to make the outer tank self-standing, and there are various problems such as that costs are liable to be high and the installation area is liable to increase. Further, according to the conventional liquefied gas tanks, since the tank is formed with a double-wall structure that is constituted by the inner tank and outer tank, there has also been the problem that the structure of an outlet for liquid cargo or piping or the like is liable to be complex. In addition, it is necessary to dispose the liquefied gas tank near equipment or facilities that use the liquefied gas tank as an energy source, and a case can arise in which a sufficient installation area cannot be secured, and it is also necessary to quickly replenish the natural gas in a case where natural gas that is used as fuel has run out.

The present invention has been created in view of the above described problems, and an object of the present invention is to provide a liquefied gas tank that can store liquefied gas that has a simple structure and requires a small installation area.

Solution to Problem

According to the present invention, there is provided a liquefied gas tank for storing liquefied gas, including: an inner tank that stores the liquefied gas and is disposed so as to be capable of self-standing on a floor surface; and an outer tank that is covered over the inner tank and is supported by an upper face portion of the inner tank; in which the outer tank is configured to be capable of sliding on the upper face portion of the inner tank in response to expansion and contraction in a horizontal direction of the inner tank and to be capable of moving in response to expansion and contraction in a vertical direction of the inner tank.

The outer tank may have an expansion and contraction mechanism portion that is disposed along a lower outer circumference thereof, or a wall surface thereof may itself be formed as a structure that is capable of expanding and contracting. Further, the inner tank and the outer tank may be configured to be attachable to and detachable from the floor surface, and the inner tank or the outer tank may be configured to be replaceable.

A base portion that supports the inner tank may be disposed on the floor surface, and a support block may be disposed between the base portion and the inner tank. In addition, a weir-like structure may be disposed on the floor surface so as to surround the base portion, and the outer tank may be connected to the weir-like structure.

The outer tank may have a penetration portion for inserting equipment into the inner tank, and a lid member may be disposed on the penetration portion. Equipment that is inserted into the inner tank may be disposed at a bottom face portion of the inner tank. An inert gas may be filled between the inner tank and the outer tank. Further, an elastic body may be disposed between the inner tank and the outer tank.

Advantageous Effects of Invention

According to the liquefied gas tank of the present invention that is described above, by configuring the inner tank so as to capable of self-standing with respect to the floor surface and causing the inner tank to support the outer tank, the structure of the outer tank can be simplified, the installation area can be reduced, and costs can be lowered. In addition, by configuring the outer tank so as to be capable of moving horizontally and capable of moving in the vertical direction, even when a cryogenic liquid such as LNG is stored in the inner tank, the inner tank can be protected from the external environment while allowing expansion and contraction (thermal expansion and thermal contraction) of the inner tank that is caused by the cryogenic liquid. Further, by adopting a simple structure, installation or replacement of the liquefied gas tank can be easily performed, and even in a case where liquid cargo is used as fuel, replenishment of the fuel can be quickly performed.

DETAILED DESCRIPTION OF THE PREFERRED EMBODIMENTS

Figure 1A:
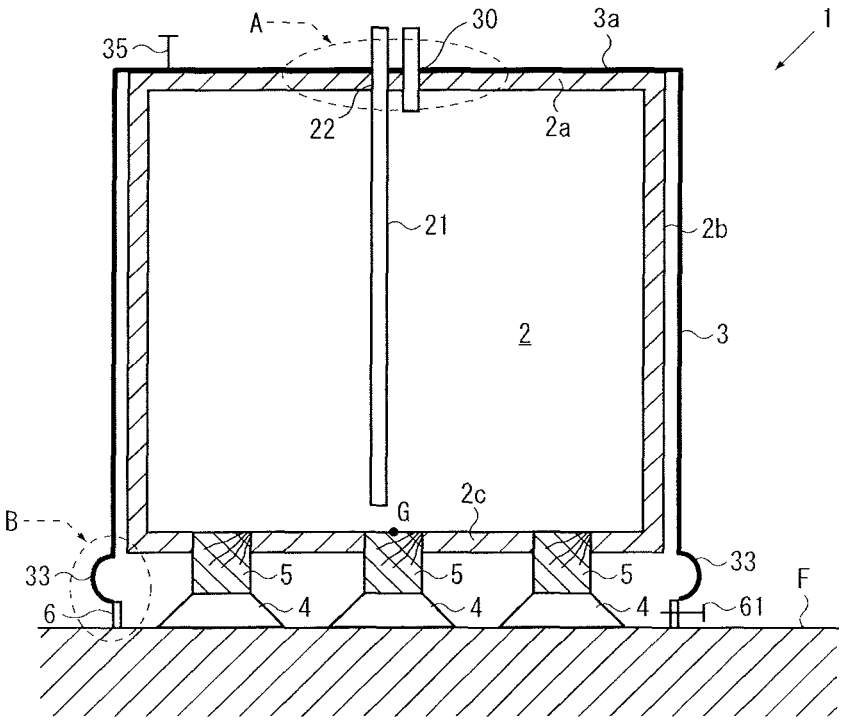
FIG. 1A shows a schematic cross-sectional view of a liquefied gas tank according to a first embodiment of the present invention.

Embodiments of the present invention are described hereunder using FIG. 1 to FIG. 11. FIGS. 1A and 1B are configuration diagrams of a liquefied gas tank according to a first embodiment of the present invention, of which FIG. 1A is a schematic cross-sectional view and FIG. 1B is a top view. FIGS. 2A and 2B are enlarged views of a portion A of the liquefied gas tank shown in FIG. 1A, in which FIG. 2A illustrates the first embodiment and FIG. 2B illustrates a first modification. FIGS. 3A and 3B are enlarged views of a portion B of the liquefied gas tank shown in FIG. 1A, in which FIG. 3A illustrates the first embodiment, FIG. 3B illustrates a first modification, FIG. 3C illustrates a second modification, and FIG. 3D illustrates a third modification.

As shown in FIGS. 1 to 3, a liquefied gas tank 1 according to the first embodiment of the present invention includes an inner tank 2 that stores liquefied gas and that is disposed so as to be capable of self-standing on a floor surface F, and an outer tank 3 that is covered over the inner tank 2 and is supported by an upper face portion 2*a* of the inner tank 2. The outer tank 3 is configured to be capable of sliding on the upper face portion 2*a* of the inner tank 2 in response to expansion and contraction in the horizontal direction of the inner tank 2, and to be capable of moving in response to expansion and contraction in the vertical direction of the inner tank 2.

The inner tank 2 is, for example, a box-shaped structure, and stores liquefied gas such as LNG (liquefied natural gas) or LPG (liquefied petroleum gas) therein. In many cases, these kinds of liquid cargo are a low temperature (for example, a very low temperature or an ultra-low temperature), and the wall surface of the inner tank 2 may have a heat insulating structure. Typically, a heat insulating material (see FIGS. 2A and 2B) is attached to the external surface of the inner tank 2.

Base portions 4 that support the inner tank 2 are disposed on the floor surface F, and support blocks 5 are disposed between the base portions 4 and the inner tank 2. The base portions 4 are metal components that are fixed to predetermined positions on the floor surface F. The support blocks 5 have a function of thermally isolating the floor surface F from the inner tank 2. For example, the support blocks 5 are made of rectangular timber, and are pushed into frame body portions formed in the inner tank 2 and thereby fitted and locked thereto. The support blocks 5 are configured so as to be capable of sliding on the base portions 4, and to be movable in response to expansion and contraction in the horizontal direction of the inner tank 2. Note that, in a case where the floor surface F is the deck of a hull or the bottom of a ship, an anti-rolling chock or anti-pitching chock may be disposed along the center line of the hull to support the horizontal load in a case where the inner tank 2 is swayed in the lateral direction or the front-and-rear direction by rolling or pitching of the hull.

Support blocks that are the same as those used for conventional LNG tanks can be appropriately used as the support blocks 5. For example, support blocks that are made of a material that has a low thermal conductivity and an elastic force such as rubber or a resin, or that are made by fixing these materials on the surface of rectangular timber may be used, and may be formed so as to be fixed to frame body portions by means of fixing fittings.

A locking portion (not shown in the drawings) that locks the side portion of the support block 5 may be disposed on the base portion 4 at approximately a center part of the bottom face of the inner tank 2. By providing the locking portion, an immobile point G can be formed whose position in the horizontal direction does not change when the inner tank 2 at expands or contracts. The locking portion, for example, is a frame body that is disposed on the center base portion 4 and surrounds all of the side portions of the support block 5.

Figure 1B:
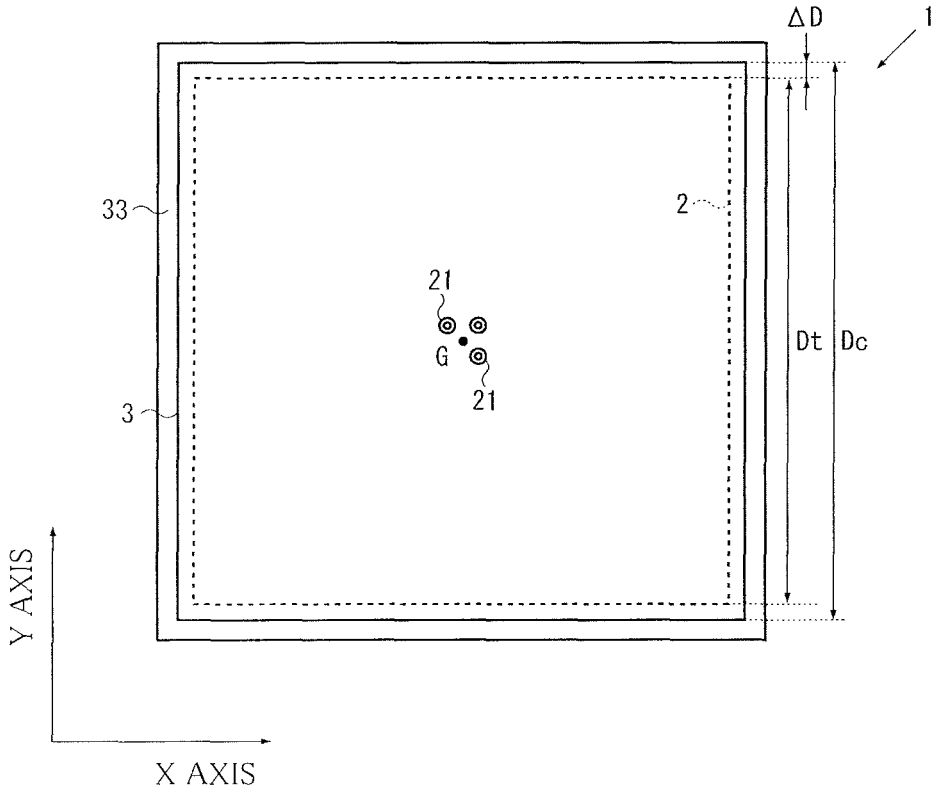
FIG. 1B shows a top view of the liquefied gas tank according to the first embodiment of the present invention.

In addition, as shown in FIG. 1B, when an X axis and a Y axis are set in directions along the horizontal direction of wall surfaces of the inner tank 2, locking portions that restrict movement in the Y-axis direction while allowing movement in the X-axis direction are formed on at least a pair of the base portions 4 disposed at approximately the center part among a plurality of the base portions 4 arranged along the X-axis direction of the inner tank 2. Further, locking portions that restrict movement in the X-axis direction while allowing movement in the Y-axis direction are formed on at least a pair of the base portions 4 disposed at approximately the center part among a plurality of the base portions 4 arranged along the Y-axis direction of the inner tank 2. Thus, a configuration may also be adopted so as to form the immobile point G at a point of intersection between an X-axis direction row and a Y-axis direction row in which the locking portions are disposed.

In addition, penetration portions 22 for inserting equipment 21 such as piping are formed at approximately the center part of an upper face portion 2*a* of the inner tank 2. The equipment 21 is supported by a supporting member (not shown in the drawings) that is disposed inside the inner tank 2 or outside the inner tank 2. As shown in FIG. 1B, the penetration portions 22 are formed over the immobile point G. By providing the penetration portions 22 for the equipment 21 such as piping over the immobile point G, even in a case where the inner tank 2 thermally expands or contracts in the horizontal direction, movement in the horizontal direction of the equipment 21 can be effectively suppressed.

The outer tank 3 is a cover for protecting the inner tank 2 (including the heat insulating material 24) from the entry of moisture into the inside thereof and also from contact or collision with a foreign body (people, weather elements, flying objects, vehicles or the like) and the like, and the outer tank 3 may be subjected to an ultraviolet ray countermeasure or a salt damage countermeasure or the like. To exert these functions, the outer tank 3 may be a multi-layered structure, may be given a surface coating (application of paint or the like), and a panel or tape may be attached to an inner surface or external surface thereof.

The outer tank 3 is constituted by, for example, a thin metal plate such as an aluminum alloy plate, a stainless steel plate, or a colored steel plate, and has a box-shaped structure that is substantially the same as that of the inner tank 2, and surrounds the external surface of the inner tank 2. At such time, the self-weight of the outer tank 3 is supported by the outer tank 3 being placed on the upper face portion 2*a* of the inner tank 2. The outer tank 3 has penetration portions 30 for inserting the equipment 21 into the inner tank 2. In a case where the penetration portions 22 and the penetration portions 30 are disposed over the immobile point G, because a relative movement amount between the penetration portions 22 and the outer tank 3 is not large, the equipment 21 and the penetration portions 30 can be joined by welding or the like.

Further, depending on the stored amount of liquefied gas in the inner tank 2 and the circumstances regarding the use thereof, in some cases the equipment 21 thermally contracts, thermally expands, or a deviation arises with respect to intervals between a plurality of items of the equipment 21. Therefore, a configuration may be adopted so as to form a rimpled structure that is capable of expanding and contracting around the equipment 21, in the outer tank 3 in an area around the penetration portions 30. In this respect, although a case in which a rimpled structure is formed at one part of the outer tank 3 in an area around the penetration portions 30 is illustrated in the drawing, all of the outer tank 3 in the area around the penetration portions 30 may have a rimpled structure, and a configuration may also be adopted that is provided with an expandable and contractible concavo-convex structure other than the rimpled structure illustrated in the drawing.

The outer tank 3 also includes a ceiling portion 3*a* that is placed on the upper face portion 2*a* of the inner tank 2. The ceiling portion 3*a* is not fixed to the upper face portion 2*a* of the inner tank 2, and the inner tank 2 and the outer tank 3 are configured so as to be capable of sliding relative to each other in the horizontal direction. Because liquefied gas having a very low temperature is stored in the inner tank 2, the inner tank 2 will thermally contract or thermally expand depending on the stored amount of liquefied gas. On the other hand, because the outer tank 3 is exposed to a normal temperature environment, a thermal contraction difference arises between the inner tank 2 and the outer tank 3. Therefore, a configuration is adopted in which a width Dc of the outer tank 3 is made larger than a width Dt of the inner tank 2 (including the heat insulating material 24), so that an expansion/contraction amount in the horizontal direction of the inner tank 2 can be absorbed by a gap $\Delta D$ ($=Dc-Dt$) between the inner tank 2 and the outer tank 3.

The size of the gap $\Delta D$ is appropriately set in accordance with expansion and contraction amounts of the inner tank 2 that are determined in accordance with conditions such as the capacity and shape of the inner tank 2, the kind of liquefied gas to be stored therein, and the structure of the outer tank 3. For example, in a case where the size of the inner tank 2 reaches a maximum size at the time of a normal temperature in an operational state of the liquefied gas tank 1, the size of the outer tank 3 can be set so that the outer tank 3 is disposed on the inner tank 2 without a gap therebetween at the time of a normal temperature.

Figure 2A:
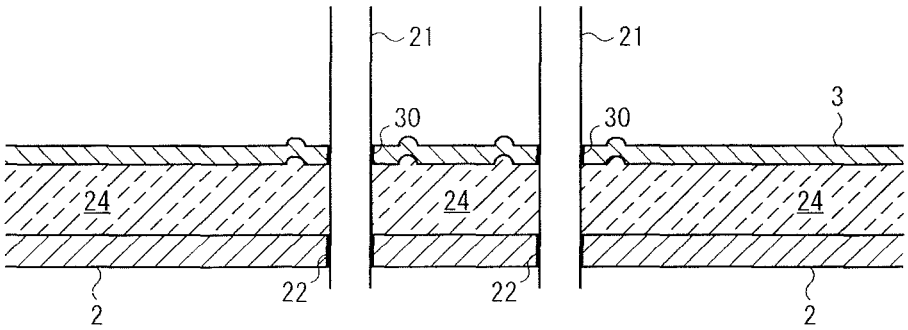
FIG. 2A shows an enlarged view of a portion A of the liquefied gas tank shown in FIG. 1A.
Figure 2B:
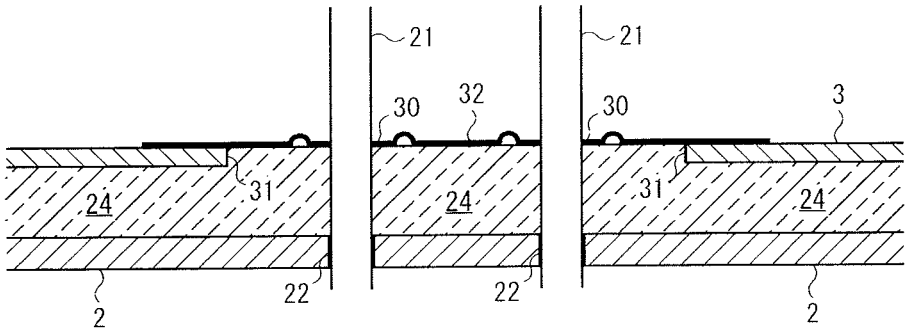
FIG. 2B shows an enlarged view of the portion A according to a first modification of the liquefied gas tank shown in FIG. 1A.

A modification of the penetration portions 30 will now be described. A first modification that is shown in FIG. 2B is one in which the penetration portions 30 are separated from the outer tank 3. More specifically, the outer tank 3 has an opening portion 31 for inserting the equipment 21 into the inner tank 2, a lid member 32 is disposed on the opening portion 31, and the penetration portions 30 are disposed in the lid member 32. By separating the penetration portions 30 from the outer tank 3 in this manner, installation work and maintenance and the like can be easily performed. The penetration portions 30 for the equipment 21 in the lid member 32 are connected thereto in an airtight manner by welding or the like. A configuration may also be adopted in which a seal member for maintaining airtightness is disposed between the lid member 32 and the outer tank 3 or in the penetration portions 30 of the lid member 32.

Further, depending on the stored amount of liquefied gas in the inner tank 2 and the circumstances regarding the use thereof, in some cases the equipment 21 thermally contracts, thermally expands, or a deviation arises with respect to intervals between a plurality of items of the equipment 21. Therefore, a configuration may be adopted so as to form a rimpled structure that is capable of expanding and contracting around the equipment 21 in the lid member 32. In this respect, although a case in which a rimpled structure is formed at one part of the lid member 32 is illustrated in the drawing, all of the lid member 32 may have a rimpled structure, and a configuration may also be adopted that is provided with an expandable and contractible concavo-convex structure other than the rimpled structure illustrated in the drawing.

Figure 3A:
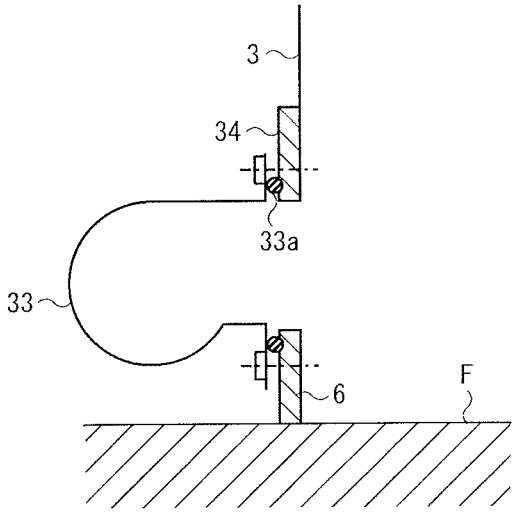
FIG. 3A shows an enlarged view of a portion B of the liquefied gas tank shown in FIG. 1B.

Further, a weir-like structure 6 is disposed so as to surround the base portions 4 on the floor surface F. A lower end portion of the outer tank 3 is connected to the weir-like structure 6. The outer tank 3 also has an expansion and contraction mechanism portion 33 that is disposed along the lower outer circumference thereof. As shown in FIG. 3A, the weir-like structure 6 is a metal component that is installed upright on the floor surface F, and is fixed to the floor surface F by means such as welding or a bolt. A thick portion 34 is formed at the lower end portion of the outer tank 3, and the expansion and contraction mechanism portion 33 is connected between the weir-like structure 6 and the thick portion 34. The thick portion 34 is a component that compensates for the fact that the thin metal plate constituting the outer tank 3 is liable to deform, and functions to maintain sufficient fastening and airtightness between the expansion and contraction mechanism portion 33 and the outer tank 3.

The expansion and contraction mechanism portion 33 is a flexible component that absorbs a movement amount of the outer tank 3 accompanying thermal expansion or contraction in the vertical direction (a perpendicular direction or a standing direction) and the horizontal direction of the inner tank 2. The inner tank 2 thermally contracts or thermally expands in the horizontal direction and the vertical direction depending on the stored amount of liquefied gas, and the outer tank 3 is configured to be capable of moving to follow the thermal contraction or thermal expansion of the inner tank 2. On the other hand, to maintain airtightness, it is necessary to connect the outer tank 3 to the weir-like structure 6 that is fixed to the floor surface F. Therefore, the outer tank 3 moves relative to the weir-like structure 6 in the horizontal direction and vertical direction. The expansion and contraction mechanism portion 33 is a component for absorbing such relative movement.

The expansion and contraction mechanism portion 33 is formed with an airtight material and structure. For example, a flexible structure obtained by forming chloroprene rubber or natural rubber or the like in a curved shape is adopted. Further, the expansion and contraction mechanism portion 33 is fixed by a fastener such as a bolt to the weir-like structure 6 and the thick portion 34 via an O-ring 33*a* that maintains airtightness. Note that a configuration may also be adopted in which the expansion and contraction mechanism portion 33 is fixed in an airtight manner to the weir-like structure 6 and the thick portion 34 by welding or the like. The expansion and contraction mechanism portion 33 is not limited to the configuration shown in FIG. 3A and, for example, may have the configuration of modifications that are illustrated in FIG. 3B to FIG. 3D.

Figure 3B:
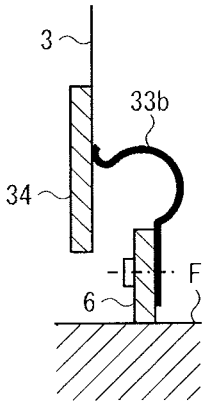
FIG. 3B shows an enlarged view of the portion B according to a first modification of the liquefied gas tank shown in FIG. 1B.

A first modification that is illustrated in FIG. 3B is one in which the expansion and contraction mechanism portion 33 is constituted by an urging member 33*b*. More specifically, the first modification has a configuration in which the urging member 33*b* that is capable of pressing from the inner side of the outer tank 3 to the outer side is fixed to the weir-like structure 6, and in which it is possible to slide the outer tank 3 in the vertical direction by means of contact pressure between the urging member 33*b* and the thick portion 34 and also maintain airtightness. The urging member 33*b* is constituted, for example, by a curved leaf spring member that is made of metal. A contact portion thereof may be coated with a coating that improves the sliding properties or the abrasion resistance thereof.

Figure 3C:
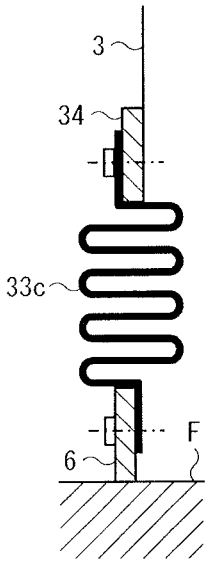
FIG. 3C shows an enlarged view of the portion B according to a second modification of the liquefied gas tank shown in FIG. 1B.

A second modification that is illustrated in FIG. 3C is one in which the expansion and contraction mechanism portion 33 is constituted by a bellows member 33*c*. More specifically, the second modification has a configuration in which the bellows member 33*c* that is obtained by forming a metal plate in a bellows shape is connected to the weir-like structure 6 and the thick portion 34. Similarly to the embodiment illustrated in FIG. 3A, a configuration may be adopted so as to arrange an O-ring in a sandwiched condition at the connection portions.

Figure 3D:
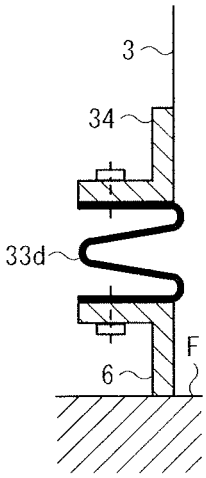
FIG. 3D shows an enlarged view of the portion B according to a third modification of the liquefied gas tank shown in FIG. 1B.

A third modification that is illustrated in FIG. 3D is one in which the expansion and contraction mechanism portion 33 is constituted by a leaf spring member 33*d*. More specifically, the third modification has a configuration in which end faces of the leaf spring member 33*d* that is obtained by bending a metal plate are connected to the weir-like structure 6 and the thick portion 34. Similarly to the embodiment illustrated in FIG. 3A, a configuration may be adopted so as to arrange an O-ring in a sandwiched condition at the connection portions. A configuration may also be adopted in which the leaf spring member 33*d* is obtained by molding chloroprene rubber or natural rubber or the like instead of using a metal plate. Note that, as illustrated in the drawing, the weir-like structure 6 and the thick portion 34 are formed in an L shape, and each has a connection face that faces the corresponding end face of the leaf spring member 33*d*.

An inert gas such as nitrogen gas may be filled between the inner tank 2 and the outer tank 3. For example, an inert gas can be filled into the gap between the inner tank 2 and the outer tank 3 by connecting an inert gas introduction pipe 61 to the weir-like structure 6 and connecting an inert gas discharge pipe 35 to the outer tank 3. The inert gas has a function as a carrier gas for pushing out moisture or air that is present in the gap between the inner tank 2 and the outer tank 3 to the outside, and acts to expel air from the area surrounding the inner tank 2 that stores liquefied gas and prevent the occurrence of an explosion even in a case where liquefied gas leaks from the inner tank 2.

Introduction of inert gas may be performed only when installing the liquefied gas tank 1 or may be performed continuously. Further, by sealing the inert gas in the gap between the inner tank 2 and the outer tank 3 and setting the pressure inside the outer tank 3 to a somewhat higher pressure than the pressure of the external environment (for example, atmospheric pressure) of the outer tank 3, entry of moisture or air or the like into the gap can be effectively suppressed. Note that the arrangement of the inert gas introduction pipe 61 and the inert gas discharge pipe 35 is not limited to the example illustrated in the drawings, and the inert gas discharge pipe 35 may be arranged in a side portion of the outer tank 3 and the inert gas introduction pipe 61 may be arranged in the outer tank 3.

Figure 4A:
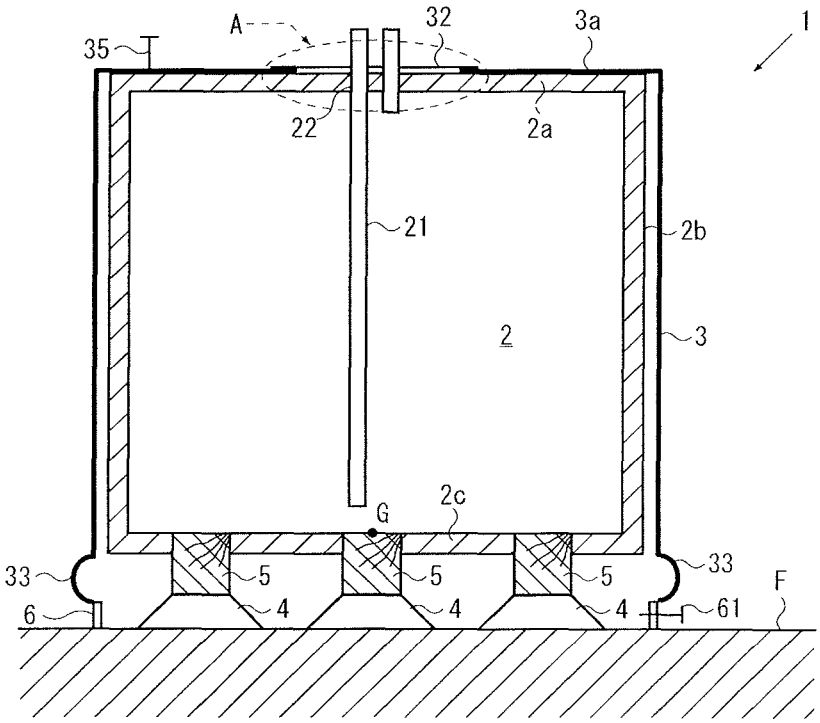
FIG. 4A shows a schematic cross-sectional view of a liquefied gas tank according to a second embodiment of the present invention.
Figure 4B:
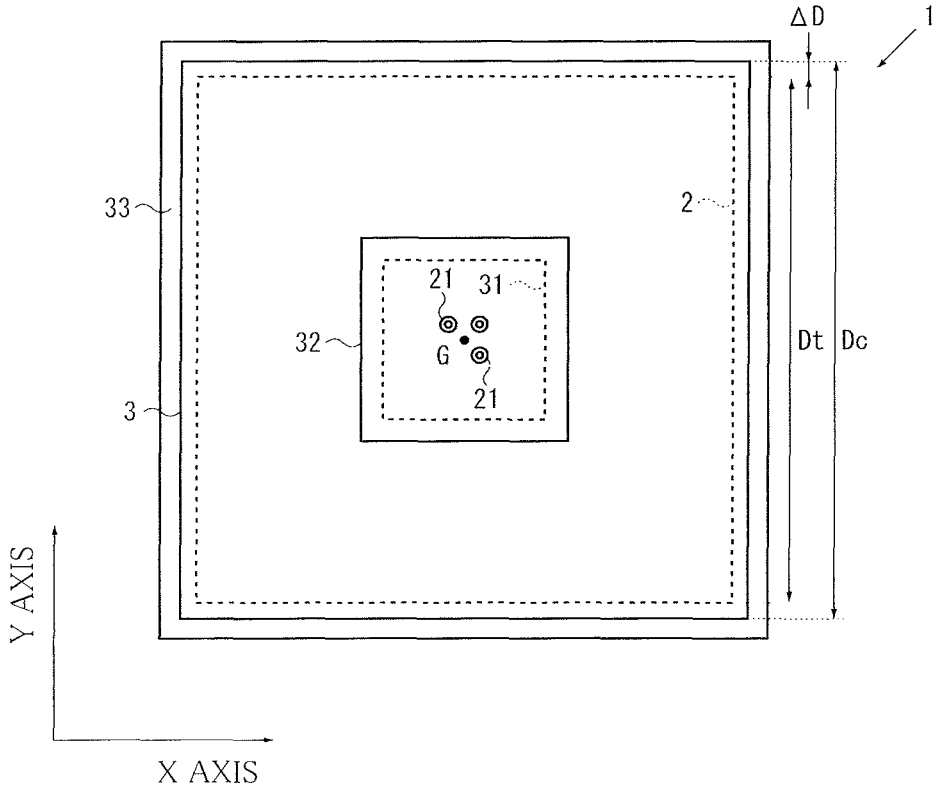
FIG. 4B shows a top view of the liquefied gas tank according to the second embodiment of the present invention.
Figure 5A:
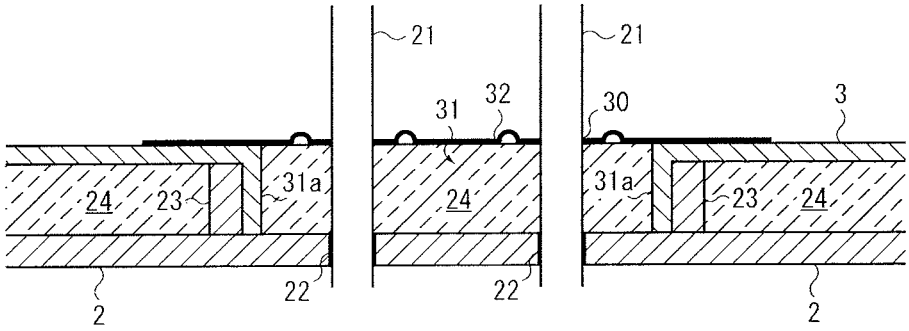
FIG. 5A shows an enlarged view of a portion A of the liquefied gas tank according to the second embodiment shown in FIG. 4A.
Figure 5B:
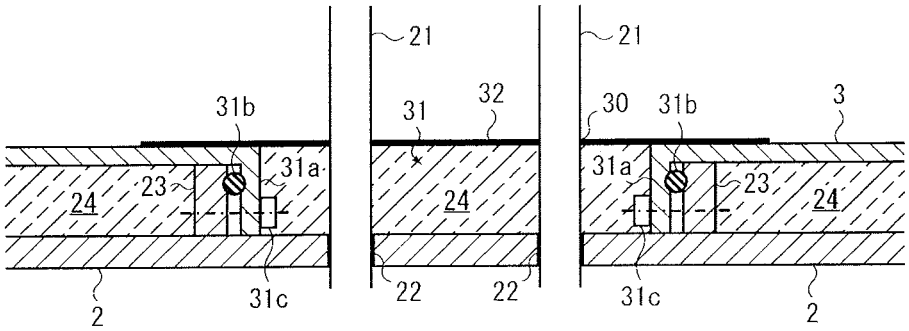
FIG. 5B shows an enlarged view of the portion A according to a first modification of the liquefied gas tank according to the second embodiment shown in FIG. 4A.
Figure 5C:
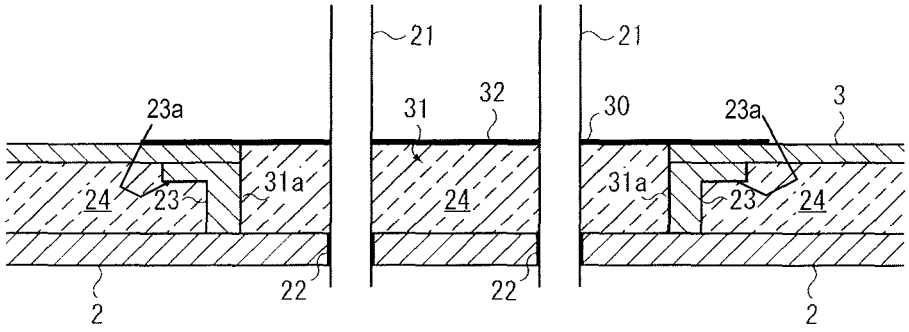
FIG. 5C shows an enlarged view of the portion A according to a second modification of the liquefied gas tank according to the second embodiment shown in FIG. 4A.

Next, a liquefied gas tank according to a second embodiment of the present invention will be described with reference to FIGS. 4A and 4B and FIGS. 5A to 5C. FIGS. 4A and 4B are configuration diagrams of a liquefied gas tank according to the second embodiment of the present invention, in which FIG. 4A shows a schematic cross-sectional view and FIG. 4B shows a top view. FIGS. 5A to 5C are enlarged views of a portion A of the liquefied gas tank shown in FIGS. 4A and 4B, in which FIG. 5A illustrates the second embodiment, FIG. 5B illustrates a first modification, and FIG. 5C illustrates a second modification. Note that components that are the same as in the above described first embodiment are denoted by the same reference characters and duplicated descriptions are omitted.

In the second embodiment and the modifications thereof that are shown in FIGS. 4A and 4B and FIGS. 5A to 5C, a coaming portion 23 is formed in the inner tank 2. Accordingly, the configuration is one in which the method of connecting the inner tank 2 and the outer tank 3 is different from the first embodiment. More specifically, penetration portions 22 for inserting the equipment 21 such as piping are formed at approximately the center part of the upper face portion 2*a* of the inner tank 2, and as shown in FIG. 5A the coaming portion 23 is formed along the outer circumference of the penetration portions 22. For example, the coaming portion 23 is formed so as to be approximately the same height as the heat insulating material 24 of the inner tank 2.

In addition, as shown in FIG. 5A, an edge portion 31*a* that is bent towards the inner side is formed in the opening portion 31 of the outer tank 3, and positioning of the outer tank 3 is performed by inserting the edge portion 31*a* along the coaming portion 23 that is formed at the outer circumference of the penetration portions 22 of the inner tank 2. The edge portion 31*a* may be inserted without any gap between the edge portion 31*a* and the coaming portion 23, or may be inserted with a certain gap therebetween. In a case where the penetration portions 22 and the opening portion 31 are disposed over the immobile point G, because a relative movement amount between the coaming portion 23 and the outer tank 3 is not large, the edge portion 31*a* and the coaming portion 23 may be joined by welding or the like. Note that in a case where the outer tank 3 can be positioned by means of another component, the edge portion 31*a* may be omitted.

After the heat insulating material 24 is filled into the space formed by the edge portion 31*a*, the lid member 32 is disposed on the opening portion 31 and is connected thereto in an airtight manner by welding or the like. The penetration portions 30 for the equipment 21 in the lid member 32 are also connected in an airtight manner by welding or the like. A configuration may also be adopted in which a seal member for maintaining airtightness is disposed between the lid member 32 and the outer tank 3 or in the penetration portions 30 of the lid member 32.

Modifications of the opening portion 31 will now be described. A first modification illustrated in FIG. 5B is configured so that the space between the coaming portion 23 and the outer tank 3 (edge portion 31*a*) is airtightly sealed and a space including the heat insulating material 24 and the like that is formed between the inner tank 2 and the outer tank 3 and a space formed by the opening portion 31 are separated. More specifically, a seal member 31*b* may be disposed between the coaming portion 23 and the edge portion 31*a*, and the space between the coaming portion 23 and the outer tank 3 may be airtightly sealed by means of a fastener 31*c* such as a bolt and nut, and the space between the coaming portion 23 and the edge portion 31*a* may be airtightly sealed by welding or the like. In this case, it is not necessary for the lid member 32 to be airtight, and the lid member 32 is fixed to the outer tank 3 by a simple connection method.

A second modification shown in FIG. 5C illustrates a case where the opening portion 31 of the outer tank 3 does not have the edge portion 31*a*. More specifically, a tip portion of the coaming portion 23 has a flange portion 23*a* whose diameter is expanded in the horizontal direction, and the outer tank 3 having the opening portion 31 is disposed on the flange portion 23*a*. According to the second modification, a configuration may be adopted so as to airtightly connect the lid member 32 to the outer tank 3 in a similar manner to the second embodiment shown in FIG. 5A, or a configuration may be adopted so as to airtightly connect the outer tank 3 and the flange portion 23*a* in a similar manner to the first modification shown in FIG. 5B.

Figure 6A:
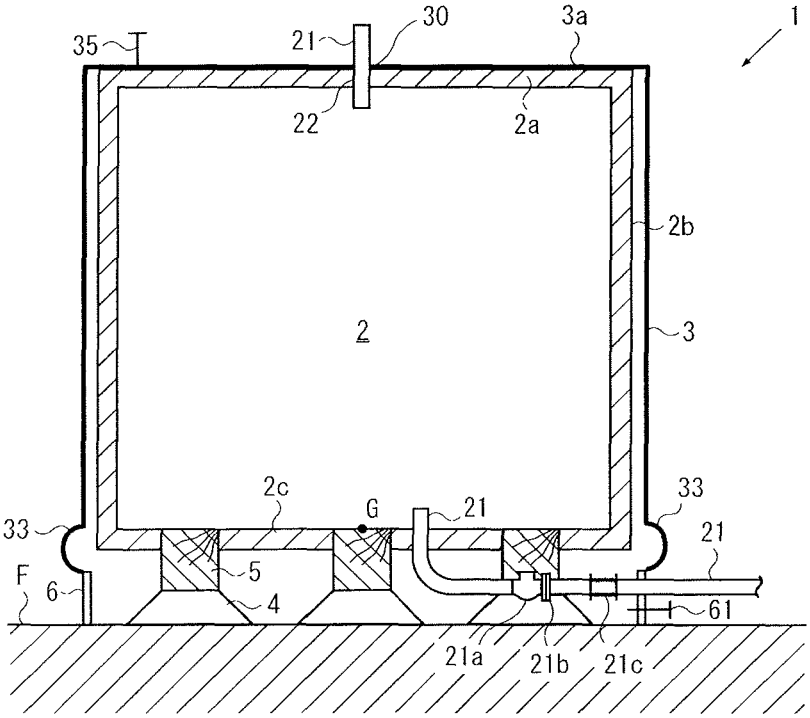
FIG. 6A shows a schematic cross-sectional view of a liquefied gas tank according to a third embodiment of the present invention.
Figure 6B:
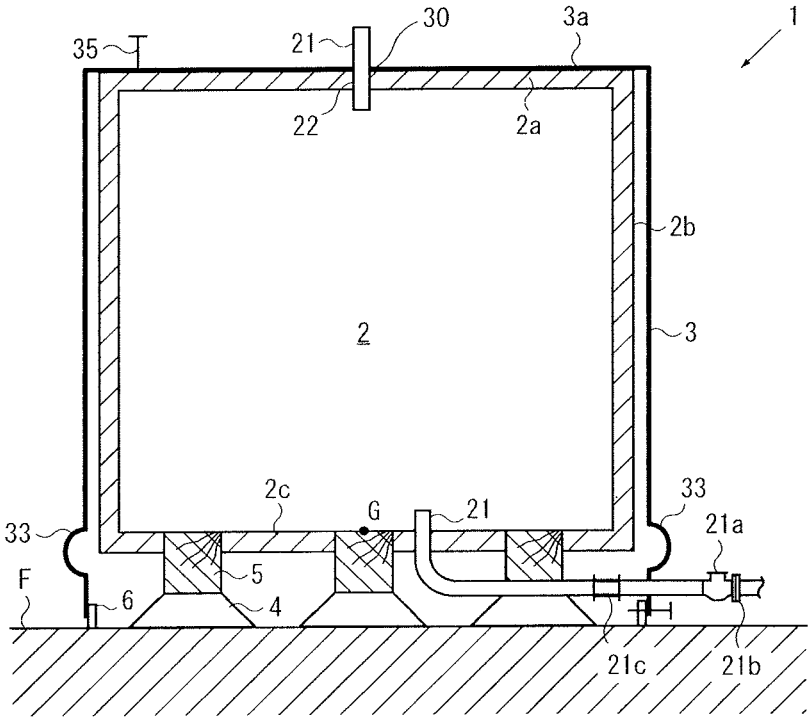
FIG. 6B shows a first modification of the liquefied gas tank according to the third embodiment of the present invention.

Next, a liquefied gas tank according to a third embodiment of the present invention will be described with reference to FIGS. 6A and 6B. FIGS. 6A and 6B are views that illustrate a liquefied gas tank according to the third embodiment of the present invention, in which FIG. 6A illustrates a schematic cross-sectional view and FIG. 6B illustrates a first modification. Note that components that are the same as in the above described first embodiment are denoted by the same reference characters and duplicated descriptions are omitted.

The third embodiment illustrated in FIG. 6A and FIG. 6B is one in which the equipment 21 that is inserted into the inner tank 2 is disposed at a bottom face portion 2*c* of the inner tank 2. More specifically, as shown in FIG. 6A, one part of the equipment 21 is configured to pass through the weir-like structure 6 and be inserted into the bottom of the inner tank 2, and thereafter pass through the bottom face portion 2*c* and enter the inside of the inner tank 2. The equipment 21 has, at an intermediate portion thereof, an opening/closing valve 21*a* that operates to open/close the equipment 21 (piping), a connection portion 21*b* that connects a fixed portion on the inner tank 2 side of the equipment 21 and a fixed portion of the weir-like structure 6, and a pipe expansion joint 21*c* that absorbs a movement amount of the equipment 21 accompanying thermal expansion or contraction of the inner tank 2. In the third embodiment shown in FIG. 6A, a configuration is adopted in which the opening/closing valve 21*a*, the connection portion 21*b*, and the pipe expansion joint 21*c* are arranged in that order and disposed between the inner tank 2 and the outer tank 3. According to this configuration, the length of the equipment 21 such as piping can be shortened, and the support structure can be simplified since it is not necessary for the outer tank 3 to support the equipment 21. In addition, in a case where the equipment 21 is fixed to the weir-like structure 6, when installing or replacing the liquefied gas tank 1, the fixed portion on the inner tank 2 side of the equipment 21 and the fixed portion of the weir-like structure 6 can be connected individually, and thereafter these fixed portions can be connected to each other by means of the connection portion 21*b*.

In contrast, in the first modification of the third embodiment that is shown in FIG. 6B, one part of the equipment 21 is configured to pass through a lower portion of the expansion and contraction mechanism portion 33 and be inserted into the bottom of the inner tank 2, and then pass through the bottom face portion 2*c* and enter the inside of the inner tank 2. According to the first modification, a configuration is adopted in which the pipe expansion joint 21*c*, the opening/closing valve 21*a*, and the connection portion 21*b* are arranged in that order, with the pipe expansion joint 21*c* being disposed between the inner tank 2 and the outer tank 3, and the opening/closing valve 21*a* and the connection portion 21*b* being disposed outside the outer tank 3. In this case, the pipe expansion joint 21*c* absorbs a movement amount of the equipment 21 accompanying relative movement between the inner tank 2 and the outer tank 3. Further, in a case where the equipment 21 is fixed to the expansion and contraction mechanism portion 33, when installing or replacing the liquefied gas tank 1, work to install or replace the equipment 21 can be performed along with work relating to the outer tank 3.

In the above described third embodiment and the first modification thereof, the configuration of the opening/closing valve 21*a*, the connection portion 21*b*, and the pipe expansion joint 21*c* is not limited to the configurations shown in the drawings, and the number of the components, the position at which to dispose the equipment 21, and the order in which the components are arranged and the like can be appropriately changed as necessary. A configuration may also be adopted in which all of the equipment 21 is concentrated at the bottom of the inner tank 2. Note that, although the above description of the third embodiment and the first modification thereof is based on the liquefied gas tank 1 described in the first embodiment, the third embodiment and the first modification thereof can also be applied to the liquefied gas tank 1 according to other embodiments such as the second embodiment.

Figure 7A:
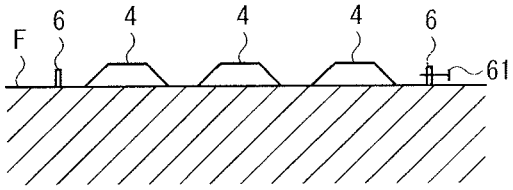
FIG. 7A is a view illustrating a method for installing the liquefied gas tank shown in FIGS. 4A and 4B, that illustrates a foundation construction process.
Figure 7B:
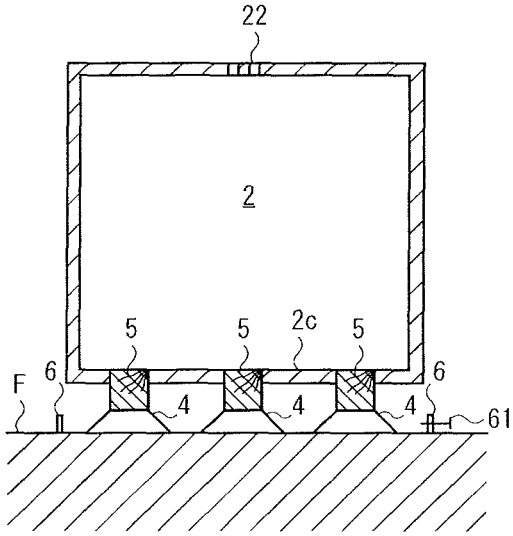
FIG. 7B is a view illustrating the method for installing the liquefied gas tank shown in FIGS. 4A and 4B, that illustrates an inner tank installation process.
Figure 7C:
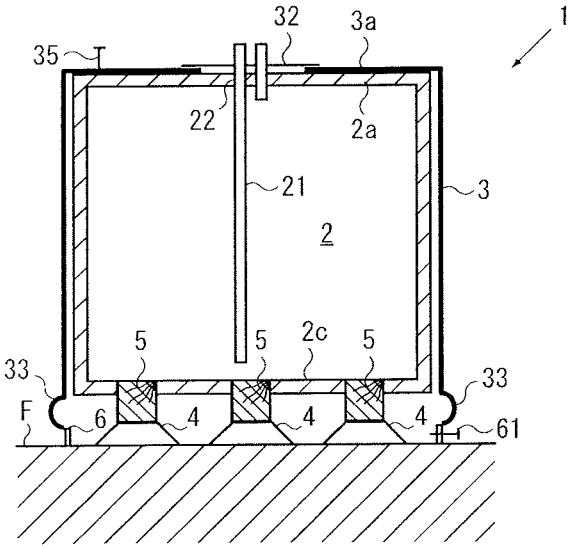
FIG. 7C is a view illustrating the method for installing the liquefied gas tank shown in FIGS. 4A and 4B, that illustrates an outer tank installation process.
Figure 8A:
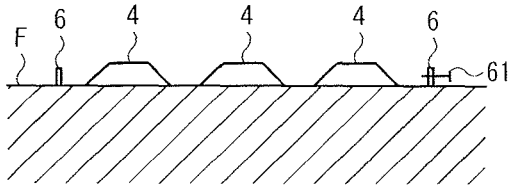
FIG. 8A is a view illustrating a modification of the method for installing a liquefied gas tank, that illustrates a foundation construction process.
Figure 8B:
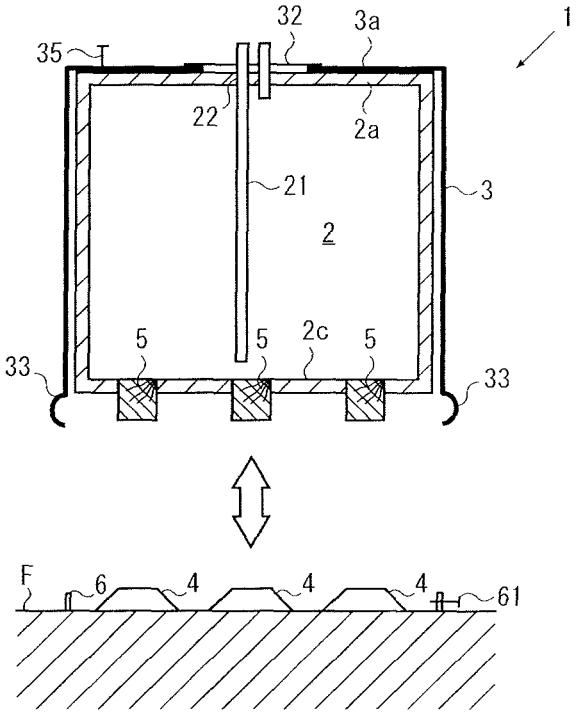
FIG. 8B is a view illustrating a modification of the method for installing a liquefied gas tank, that illustrates an inner and outer tank installation process.

Next, a method of installing the above described liquefied gas tank 1 is described with reference to FIGS. 7A to 7C and FIGS. 8A and 8B. FIGS. 7A to 7C are views that illustrate a method of installing the liquefied gas tank according to the second embodiment that is illustrated in FIGS. 4A and 4B, in which FIG. 7A illustrates a foundation construction process, FIG. 7B illustrates an inner tank installation process, and FIG. 7C illustrates an outer tank installation process. FIGS. 8A and 8B are views that illustrate a modification of the method of installing the liquefied gas tank, in which FIG. 8A illustrates a foundation construction process and FIG. 8B illustrates an inner and outer tank installation process.

The foundation construction process illustrated in FIG. 7A is a process for installing the base portions 4 and the weir-like structure 6 on the floor surface F. The inner tank installation process illustrated in FIG. 7B is a process for installing the inner tank 2 on the base portions 4. More specifically, the support blocks 5 are locked to the underside of the inner tank 2, and the support blocks 5 are placed on the base portions 4. The outer tank installation process illustrated in FIG. 7C is a process for covering the outer tank 3 over the inner tank 2 and connecting the outer tank 3 to the weir-like structure 6. More specifically, the outer tank 3 is covered over the inner tank 2 so that the ceiling portion 3*a* of the outer tank 3 is supported by the upper face portion 2*a* of the inner tank 2, and the outer tank 3 is fixed to the weir-like structure 6 by connecting the thick portion 34 at the lower end portion of the outer tank 3 and the weir-like structure 6 by means of the expansion and contraction mechanism portion 33. Thereafter, the equipment 21 is inserted into the inside of the inner tank 2 and fitted, and the lid member 32 is connected to the outer tank 3 by passing the equipment 21 through the lid member 32. Loading equipment such as a crane is used to transport and move the inner tank 2, the outer tank 3, the equipment 21 and the like. Note that fitting of the equipment 21 may be performed before installing the inner tank 2 on the base portions 4, or may be performed before mounting the outer tank 3. Further, the expansion and contraction mechanism portion 33 may be installed at the thick portion 34 of the outer tank 3 before mounting the outer tank 3.

The outer tank 3 and the inner tank 2 can be easily moved from the base portions 4 by detaching the expansion and contraction mechanism portion 33. That is, the inner tank 2 and the outer tank 3 are configured to be attachable to and detachable from the floor surface F, and the inner tank 2 and the outer tank 3 are each configured to be replaceable. Accordingly, even in a case where there is no remaining liquefied gas stored in the inner tank 2, liquefied gas to be used as fuel can be replenished by merely replacing the inner tank 2. Further, it is possible to fill liquefied gas into the inner tank 2 in advance at a factory or a storage depot or the like and transport the inner tank 2 using a vehicle or the like, and thus the liquefied gas tank 1 can be easily installed even at a location that is far from a storage depot.

The modification of the method of installing the liquefied gas tank 1 that is illustrated in FIGS. 8A and 8B is one in which the outer tank 3 is covered over the inner tank 2 beforehand, and thereafter the inner tank 2 and the outer tank 3 are placed in that state on the base portions 4. A foundation construction process illustrated in FIG. 8A is a process for installing the base portions 4 and the weir-like structure 6 on the floor surface F. In the inner and outer tank installation process shown in FIG. 8B, an assembly formed by covering the outer tank 3 over the inner tank 2 and connecting the equipment 21 and the like thereto that is constructed in advance at a factory or a storage depot or the like is placed on the base portions 4. A configuration is adopted so that the expansion and contraction mechanism portion 33 connects the thick portion 34 of the outer tank 3 and the weir-like structure 6. According to this method also, the inner tank 2 and the outer tank 3 can be configured to be attachable to and detachable from the floor surface F. Further, the expansion and contraction mechanism portion 33 may be installed at the thick portion 34 of the outer tank 3 before placing the inner and outer tank assembly on the base portions 4.

According to the above described liquefied gas tank 1 of the present embodiment, by configuring the inner tank 2 so as to capable of self-standing with respect to the floor surface F and causing the inner tank 2 to support the outer tank 3, the structure of the outer tank 3 can be simplified, the installation area can be reduced, and costs can be lowered. In addition, by configuring the outer tank 3 to be capable of moving horizontally and capable of moving in the vertical direction relative to the inner tank 2, even when liquefied gas such as LNG is stored in the inner tank 2, the inner tank 2 can be protected from the external environment while allowing expansion and contraction (thermal expansion and thermal contraction) of the inner tank 2 that is caused thereby. Further, by adopting a simple structure, installation or replacement of the liquefied gas tank 1 can be easily performed, and even in a case where liquefied gas is used as fuel, replenishment of the fuel can be quickly performed.

In particular, even at a remote location that does not have a depot that accepts LNG or at an area (exposed part) that is not surrounded by a hull construction or the like such as an area on the deck of a ship or a floating structure, a liquefied gas tank can be easily installed, and liquefied gas can be used as fuel for generating electric power or as a propellant.

Figure 9A:
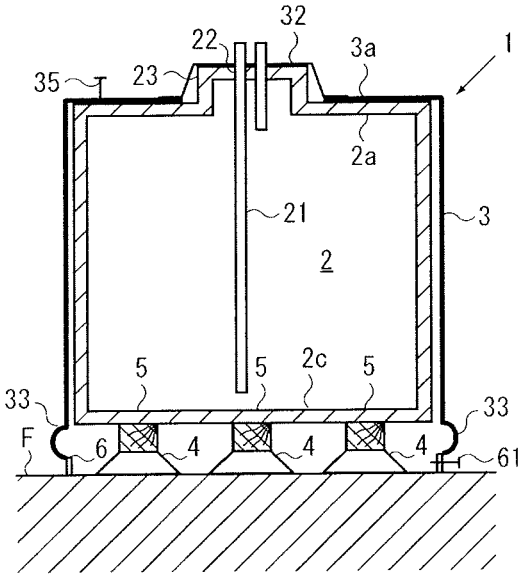
FIG. 9A is a schematic cross-sectional view showing a liquefied gas tank according to a fourth embodiment of the present invention.
Figure 9B:
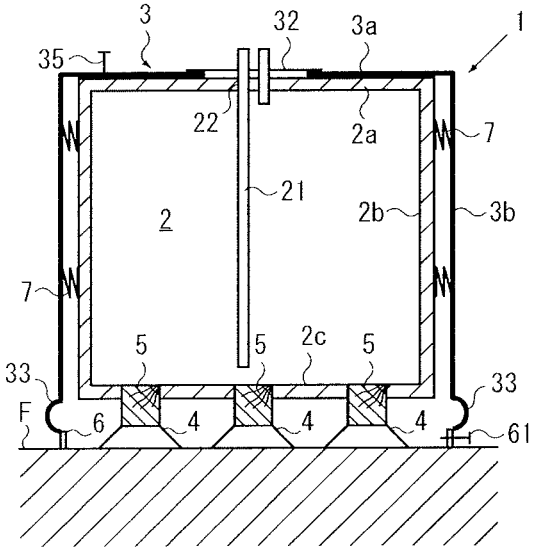
FIG. 9B is a schematic cross-sectional view showing a liquefied gas tank according to a fifth embodiment of the present invention.
Figure 9C:
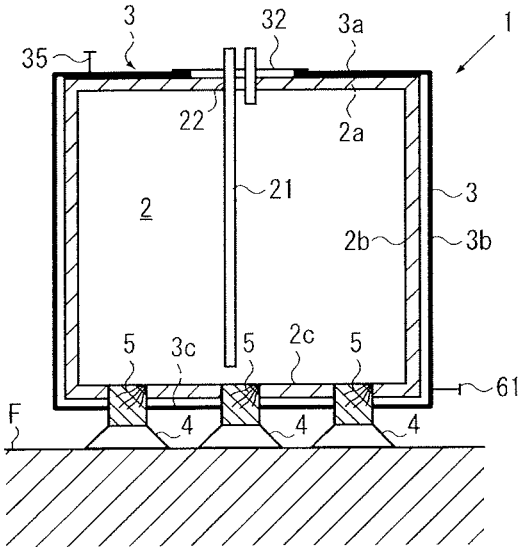
FIG. 9C is a schematic cross-sectional view showing a liquefied gas tank according to a sixth embodiment of the present invention.
Figure 10A:
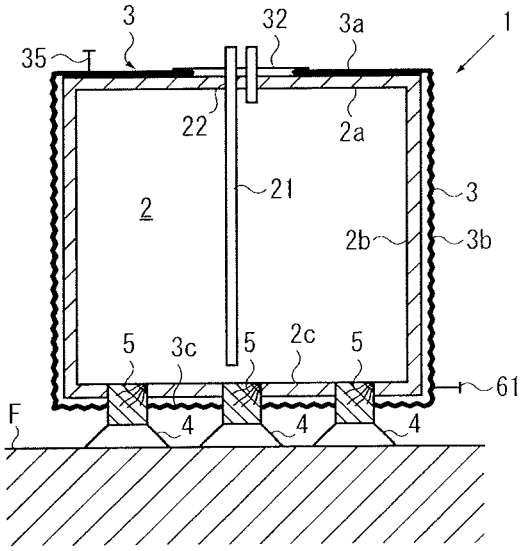
FIG. 10A shows a schematic cross-sectional view of a liquefied gas tank according to a seventh embodiment of the present invention.
Figure 10B:
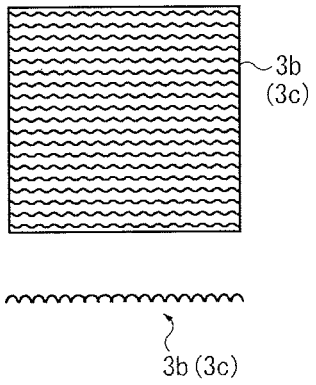
FIG. 10B shows a diagram illustrating the structure of the outer tank wall surface in the liquefied gas tank according to the seventh embodiment of the present invention.
Figure 10C:
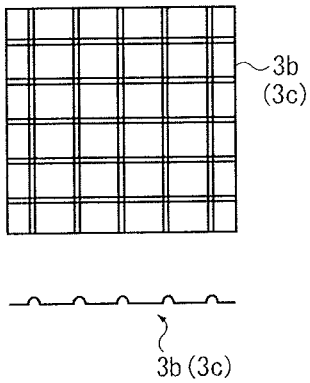
FIG. 10C shows a first modification of the structure of the outer tank wall surface in the liquefied gas tank according to the seventh embodiment of the present invention.
Figure 10D:
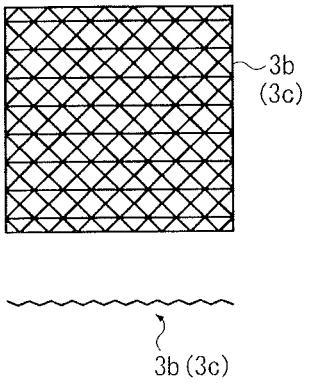
FIG. 10D shows a second modification of the structure of the outer tank wall surface in the liquefied gas tank according to the seventh embodiment of the present invention.
Figure 11A:
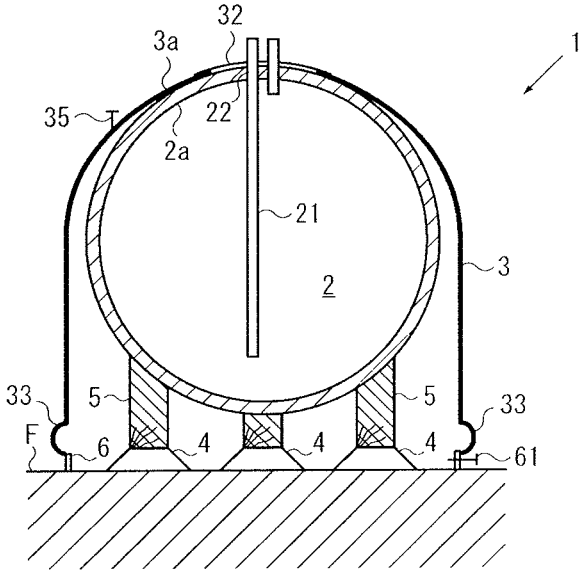
FIG. 11A shows a schematic cross-sectional view of a liquefied gas tank according to an eighth embodiment of the present invention.
Figure 11B:
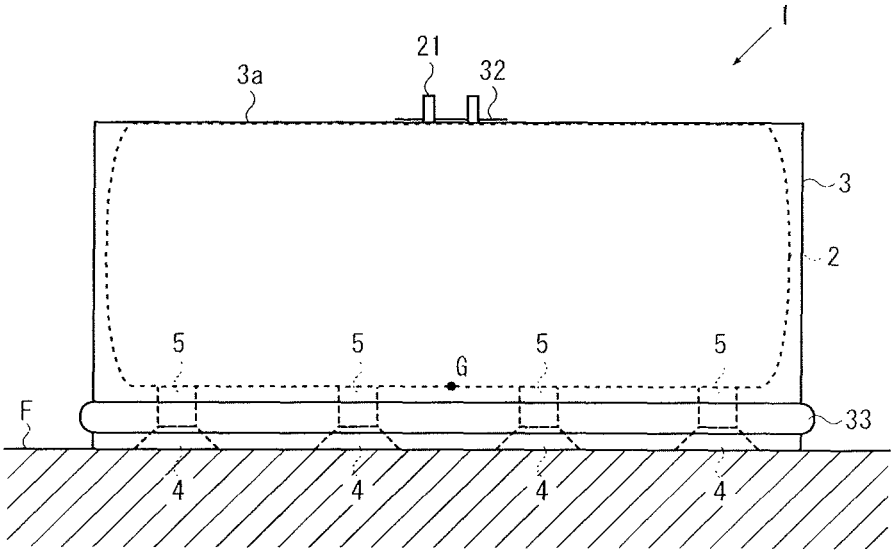
FIG. 11B shows a side view of the liquefied gas tank according to the eighth embodiment of the present invention.

Next, the liquefied gas tank 1 according to other embodiments of the present invention is described referring to FIGS. 9 to 11. FIGS. 9A to 9C are schematic cross-sectional views that illustrate liquefied gas tanks according to other embodiments of the present invention, in which FIG. 9A illustrates a fourth embodiment, FIG. 9B illustrates a fifth embodiment, and FIG. 9C illustrates a sixth embodiment. FIGS. 10A to 10D are diagrams illustrating the structure of a liquefied gas tank according to a seventh embodiment of the present invention, in which FIG. 10A shows a schematic cross-sectional view, FIG. 10B shows a diagram that illustrates the structure of the outer tank wall surface, FIG. 10C illustrates a first modification of the structure of the outer tank wall surface, and FIG. 10D illustrates a second modification of the structure of the outer tank wall surface. FIGS. 11A and 11B are configuration diagrams of a liquefied gas tank according to an eighth embodiment of the present invention, in which FIG. 11A shows a schematic cross-sectional view and FIG. 11B shows a side view. Note that components that are the same as in the above described first embodiment or second embodiment are denoted by the same reference characters and duplicated descriptions are omitted.

The liquefied gas tank 1 according to the fourth embodiment that is illustrated in FIG. 9A is one in which an penetration portion for the equipment 21 is formed in a dome structure. More specifically, the fourth embodiment has a structure in which the coaming portion 23 that is formed in the inner tank 2 is caused to protrude further upward than the ceiling portion 3*a* of the outer tank 3. As shown in the drawing, the lid member 32 may have a convex portion that covers the opening portion 31, or may be a flat shape that covers only the upper face portion of the coaming portion 23. The penetration portion for the equipment 21 in the inner tank 2 and outer tank 3, for example, has the same configuration as the configuration shown in FIG. 5A to FIG. 5C. Note that although the fourth embodiment that is illustrated in the drawing is based on the second embodiment, a similar configuration can also be applied with respect to the first embodiment.

The liquefied gas tank 1 according to the fifth embodiment that is illustrated in FIG. 9B is one in which an elastic body 7 is disposed between the inner tank 2 and the outer tank 3. The elastic body 7 is a component that suppresses movement of the outer tank 3 by transmitting an external force that acts on the outer tank 3 due to wind pressure or the like to the inner tank 2. More specifically, a plurality of the elastic bodies 7 are disposed between side portions 2*b* of the inner tank 2 and side portions 3*b* of the outer tank 3, and are configured so as to urge the outer tank 3 in the horizontal direction. Components of various forms such as a coiled spring, a rubber member, or a hydraulic damper can be used as the elastic body 7. Note that although the fifth embodiment that is illustrated in the drawing is based on the second embodiment, a similar configuration can also be applied with respect to the first embodiment.

The liquefied gas tank 1 according to the sixth embodiment that is illustrated in FIG. 9C is one in which the entire surface of the inner tank 2 is covered by the outer tank 3. More specifically, a configuration is adopted so as to cover the bottom face portion 2*c* of the inner tank 2 with a bottom face portion 3*c* of the outer tank 3. At such time, the bottom face portion 3*c* of the outer tank 3 is disposed so as to avoid the support blocks 5, and may be configured so as to be capable of sliding in the vertical direction along the support blocks 5. A seal member may be disposed between the support blocks 5 and the bottom face portion 3*c* of the outer tank 3, and a configuration may also be adopted so as to supply an inert gas from the inert gas introduction pipe 61 into the gap between the inner tank 2 and the outer tank 3 to achieve a pressurized state therein. In the sixth embodiment, the weir-like structure 6 can be omitted. Note that although the sixth embodiment that is illustrated in the drawing is based on the second embodiment, a similar configuration can also be applied with respect to the first embodiment.

Further, a configuration may also be adopted in which the outer tank 3 is constituted by aluminum tape for moisture prevention instead of a thin metal plate. Because the aluminum tape has adhesiveness, according to this configuration the outer tank 3 is directly attached to the external surface of the inner tank 2. At such time, it is good to provide the aluminum tape with a moderate amount of slack so that the aluminum tape can change shape in response to expansion and contraction of the inner tank 2.

The liquefied gas tank 1 according to the seventh embodiment that is illustrated in FIG. 10A is one in which, with respect to the sixth embodiment illustrated in FIG. 9C, the side portions 3*b* and the bottom face portion 3*c* of the outer tank 3 are formed in a structure such that the wall surfaces themselves are capable of expanding and contracting. More specifically, as shown in FIG. 10B, the wall surface constituting the side portions 3*b* and the bottom face portion 3*c* of the outer tank 3 has a rimpled structure in which a plurality of minute concavities and convexities are formed in succession. Note that in the respective drawings of FIG. 10B to FIG. 10D, the upper section shows a plan view and the lower section shows a cross-sectional view.

Furthermore, as shown in FIG. 10C, a wall surface constituting the side portions 3*b* and the bottom face portion 3*c* of the outer tank 3 may be a lattice-like structure in which groove portions are formed at regular intervals in the horizontal direction and vertical direction, or as shown in FIG. 10D, may be a diamond-cut structure in which a concavo-convex face of a predetermined shape is formed over the entire surface. In each of these configurations, the wall surfaces constituting the side portions 3*b* and the bottom face portion 3*c* of the outer tank 3 are capable of expanding and contracting in the horizontal direction and vertical direction, and can absorb a difference in an expansion/contraction amount with respect to the inner tank 2. Note that a configuration may also be adopted in which the expansion/contraction structure shown in any of FIG. 10B to FIG. 10D is applied to the ceiling portion 3*a* of the outer tank 3. Furthermore, the expansion/contraction structures shown in FIG. 10B to FIG. 10D may also be applied to the side portions 3*b* of the outer tank 3 and the ceiling portion 3*a* of the outer tank 3 according to the first to fifth embodiments.

The liquefied gas tank 1 according to an eighth embodiment that is illustrated in FIG. 11A and FIG. 11B is one in which the inner tank 2 is constructed in a cylindrical shape. When importance is placed on storage efficiency, it is preferable to make the inner tank 2 a rectangular shape as shown in FIG. 1. On the other hand, when importance is placed on the pressure-resistance performance of the inner tank 2, the inner tank 2 may be made a cylindrical shape as shown in FIG. 11A and FIG. 11B. When the inner tank 2 is made a cylindrical shape, the ceiling portion 3*a* of the outer tank 3 can be formed in a curved shape along the upper face portion 2*a* of the inner tank 2, and the lid member 32 can also be formed in a curved shape that follows the shape of the ceiling portion 3*a* of the outer tank 3. Note that the cross-sectional shape of the inner tank 2 is not limited to the circular shape shown in the drawing, and may also be an elliptical shape.

In the first embodiment to eighth embodiment that are described above, when liquefied gas is used as a fuel, the capacity of the inner tank 2 is, for example, a size of approximately 500 to 5000 $m^3$, and by making the structure of the liquefied gas tank 1 (in particular, the outer tank 3) a simple structure it is possible to save space. Accordingly, the liquefied gas tank 1 can be easily installed even in a comparatively narrow space in a part of a factory or on the deck of a hull or the like. In particular, when installing the liquefied gas tank 1 on the deck of a hull, because the visibility will be obstructed if the liquefied gas tank 1 is constructed with a large height, a configuration may be adopted in which the inner tank 2 is formed in a substantially tabular rectangular shape with a low height, or is formed in a cylindrical shape that is laid onto its side as in the eighth embodiment, or in a shape obtained by forming a cylindrical shape into a flat shape. Note that the shapes of the inner tank 2 and the outer tank 3 are not limited to the shapes described above, and the inner tank 2 and the outer tank 3 can be formed in various shapes, such as a polygonal cross-sectional shape and a concavo-convex cross-sectional shape, in accordance with the installation area and the installation space.

The present invention is not limited to the above described embodiments, and naturally various modifications can be made without departing from the spirit and scope of the present invention, such as that the present invention can also be applied to liquefied gas (for example, LPG) other than LNG (liquefied natural gas), and that the first embodiment to eighth embodiment can be suitably combined and used.

REFERENCE SIGNS LIST

1 Liquefied gas tank
2 Inner tank
2*a* Upper face portion
3 Outer tank
4 Base portion
5 Support block
6 Weir-like structure
7 Elastic body
21 Equipment
30 Penetration portion
31 Opening portion
32 Lid member
33 Expansion and contraction mechanism portion

What is claimed is:

1. A liquefied gas tank for storing liquefied gas, comprising:

an inner tank that stores the liquefied gas and is disposed so as to be capable of self-standing on a floor surface; and an outer tank placed over the inner tank such that the outer tank rests on and is supported by a weight bearing upper face portion of the inner tank;

wherein the outer tank is configured to be capable of sliding on the upper face portion of the inner tank in response to expansion and contraction in a horizontal direction of the inner tank and to be capable of moving in response to expansion and contraction in a vertical direction of the inner tank while continuously being supported on the weight bearing upper face of the inner tank.

2. The liquefied gas tank according to claim 1, wherein the outer tank comprises an expansion and contraction mechanism portion that is disposed along a lower outer circumference thereof, or a wall surface thereof is itself formed as a structure that is capable of expanding and contracting.

3. The liquefied gas tank according to claim 1, wherein the inner tank and the outer tank are configured to be attachable to and detachable from the floor surface, and the inner tank or the outer tank is configured to be replaceable.

4. The liquefied gas tank according to claim 1, wherein a base portion that supports the inner tank is disposed on the floor surface, and a support block is disposed between the base portion and the inner tank.

5. The liquefied gas tank according to claim 4, wherein a weir-like structure is disposed on the floor surface so as to surround the base portion, and the outer tank is connected to the weir-like structure.

6. The liquefied gas tank according to claim 1, wherein the outer tank comprises a penetration portion for inserting equipment into the inner tank, and a lid member is disposed on the penetration portion.

7. The liquefied gas tank according to claim 1, wherein equipment that is inserted into the inner tank is disposed at a bottom face portion of the inner tank.

8. The liquefied gas tank according to claim 1, wherein an inert gas is filled between the inner tank and the outer tank.

9. The liquefied gas tank according to claim 1, wherein an elastic body is disposed between the inner tank and the outer tank.

* * * * *